US006512157B1

(12) United States Patent
Phillips et al.

(10) Patent No.: US 6,512,157 B1
(45) Date of Patent: Jan. 28, 2003

(54) SUBGRADE RADIOACTIVE AND HAZARDOUS WASTE MONOLITH PACKAGING STRUCTURAL CONTAINMENT SYSTEM

(75) Inventors: Steven J. Phillips, Richland; Robert G. Alexander, Kennewick; Seleste A. Williams, West Richland, all of WA (US)

(73) Assignee: AGEC, Richland, WA (US)

( * ) Notice: Subject to any disclaimer, the term of this patent is extended or adjusted under 35 U.S.C. 154(b) by 0 days.

(21) Appl. No.: 09/468,725

(22) Filed: Dec. 21, 1999

(51) Int. Cl.[7] ..... G21F 9/00
(52) U.S. Cl. ..... 588/3; 588/252
(58) Field of Search ..... 588/3, 16, 252, 588/259, 260, 257; 422/159

(56) References Cited

U.S. PATENT DOCUMENTS 3,983,050 A * 9/1976 Mecham ..... 252/301.1 W
5,156,818 A * 10/1992 Manchak, Jr. ..... 422/159
5,819,787 A * 10/1998 Caparros ..... 137/377

* cited by examiner

*Primary Examiner*—Stanley S. Silverman
*Assistant Examiner*—Edward M. Johnson
(74) *Attorney, Agent, or Firm*—Steven J. Phillips; Robert G. Alexander

(57) ABSTRACT

An economical and efficient method for forming a waste containing monolith which meets applicable waste disposal laws, rules and regulations. Removable walls are attached to at least one side of the monolith, thereby forming an interior volume defined by the removable walls and at least one side of the monolith. Waste is placed within the interior volume, whereupon it is submerged in a flowable, curable, monolith forming material (typically concrete) by filling the interior volume with a monolith forming material, and allowing the monolith forming material to cure to a solidified state, thereby forming an expanded monolith integral with the existing monolith. The walls are then removed, thereby leaving the waste encased within said expanded monolith and allowing the removable walls to be reused for further expansion of the monolith.

70 Claims, 3 Drawing Sheets

SUBGRADE RADIOACTIVE AND HAZARDOUS WASTE MONOLITH PACKAGING STRUCTURAL CONTAINMENT SYSTEM

FIELD OF THE INVENTION

The present invention relates generally to packaging of radioactive and/or hazardous waste in below grade trenches or excavations used for long term containment of the waste. Specifically, the present invention is an economical and efficient method for forming a waste containing monolith which meets applicable waste disposal laws, rules and regulations.

BACKGROUND OF THE INVENTION

The development of effective methods for the long term disposal of radioactive and/or hazardous wastes in an efficient and economic manner has proven to be a challenging problem. A variety of unfavorable characteristics present in these wastes dictate the use of solutions and methods which insure the effective isolation of these wastes from the environment for long periods of time for health and safety reasons. These characteristics include, but are not limited to, toxicity, radioactivity, and leachability in ground water. Other characteristics which may be present in these wastes, such as corrosiveness, rule out many potential disposal schemes as viable, long term solutions.

To protect human health and the environment, the United States and foreign governments have set up a variety of laws, rules, and regulations which govern the acceptable disposal of many of these wastes. One scheme currently allowed under the laws, rules and regulations of the United States permits these wastes to be contained within concrete monoliths, which are then buried in trenches and excavations for long term disposal. Over the course of the last several years, such disposal schemes have evolved to increase the efficiency and lower the cost of disposing of wastes in this manner.

For example, in the past it was common for concrete boxes with open tops to be fabricated, and then have wastes placed inside these boxes for disposal. Concrete boxes used for in these methods were typically fabricated, either on or off site, using common concrete construction methods, whereby forms, typically fashioned of plywood or an equivalent material, were constructed to define the exterior and interior dimensions of the concrete boxes. After placing material such as reinforcing bar, for reinforcing and adding structural strength to the concrete within the interior of the forms, Portland cement and concrete additive materials were then poured in and allowed to cure. Once the concrete cured, the forms were then removed, leaving a solidified, concrete box. The thus formed concrete box was then ready for accepting waste. If fabricated off site, the concrete boxes were then placed in position within a trench or excavation, and waste was then loaded over the exterior walls of the concrete boxes, typically with a crane, and placed in the interior of the boxes. The loading of these wastes could be an expensive and time consuming process. Wastes arriving in trucks for disposal needed to be removed from the trucks and transported, typically with a crane, over the walls of the concrete boxes for placement within. The hazardous nature of the wastes dictated that stringent safety procedures be followed. Additionally, some radioactive wastes with high levels of activity dictated the use of remote handling techniques which greatly complicated the movement of the wastes from the delivery trucks, onto the cranes, and into the interior of the concrete boxes. Once the waste was placed in the interior of these concrete boxes, and a concrete top was placed over the box and the box was buried. Drawbacks of this method included very low waste loading efficiency and gaps between the boxes.

These and other drawbacks then led to the development of methods whereby the boxes were fabricated utilizing form-type construction, with one end left open. In this manner, trucks delivering waste could access the interior of the boxes without the necessity of loading wastes over the walls with a crane. Once wastes are placed in the interior of the boxes utilizing this method, the open end is then closed, by fabricating an end to the box, using the same form-type construction. The thus completed box is then filled with concrete to capture the waste in a concrete.

A large disposal site, consisting of a trench or excavation, will typically be sequentially filled with many, separately fabricated concrete monoliths repetitively formed in this manner and using common walls, thereby forming a single, large monolith. The thus formed monolith is then covered with barriers as specified in applicable laws, rules and regulations, and buried. This method of forming a series of boxes, each with an open end, loading the waste into the box, and then fabricating a form to construct a closed end, and then filling the thus formed concrete box with concrete, represents the current state of the art method for containing wastes in concrete monoliths which is allowed under current laws, rules and regulations.

However, this state of the art method poses several drawbacks which add to the overall cost and inefficiency of the process. For example, the construction of boxes using the traditional forms requires significant labor and time to build the forms. Additionally, the fabrication of an open ended box, the end for the box, and the addition of the concrete to the waste in the interior of the box, all must be performed sequentially if waste is to be loaded into the interior of the concrete boxes directly from delivery trucks, and without the use of expensive cranes and rigging and the attendant safety precautions. The cumulative time required to wait for each of the various stages to be completed, including the time for the concrete to cure in each of these sequential steps, renders the overall process for forming each concrete monolith time consuming and expensive.

Thus, there exists a need for an improved method for forming concrete monoliths containing hazardous and/or radioactive wastes which is less labor intensive, has lower cost, is less time consuming, and allows efficient covering with barriers mandated by existing laws, rules and regulations.

OBJECTS

Accordingly, it is an object of the present invention to provide an improved method for forming a concrete monolith containing radioactive and/or hazardous wastes which minimizes the necessary labor, time and expense.

It is another object of the present invention to provide a method for forming the concrete monolith utilizing removable walls, which may be repeatedly used in the formation of other monoliths, or in the expansion of the original monolith.

It is another object of the present invention to provide a method for forming a concrete monolith utilizing removable walls, which allows for the encapsulation of waste simultaneous with the formation of the monolith, and without preformed walls to contain waste deposited therein.

It is another object of the present invention to provide a method for expanding a concrete monolith, wherein the expansion of the monolith is formed integrally with the existing monolith, and where the method allows for the encapsulation of waste simultaneous with the expansion of the monolith, and without a need for the construction of walls to contain waste deposited therein.

SUMMARY OF THE INVENTION

These and other objects are accomplished by forming a monolith containing hazardous and/or radioactive wastes by first forming an interior volume by placing removable walls on the site, pouring a flowable, curable, monolith forming material into the interior volume, thereby forming a floor within the interior volume, placing waste within the interior volume, submerging the waste within a second application of the monolith forming material by placing the second application of the monolith forming material within the interior volume, allowing the monolith forming material to cure to a solidified state, thereby forming a monolith with the waste encased within the monolith, and removing the walls. Alternatively, the floor may be first formed utilizing standard construction practices, and the method of the present invention is then practiced in the same manner as set forth above, except the removable walls are placed on top of the floor. Under either approach, the floor is typically constructed of concrete suitable for supporting the wastes placed thereon. As will be recognized by those having skill in the art, a monolith formed by the method of the present invention may also provide a suitable floor for vertical expansion of the monolith, again by utilizing the method of the present invention as set forth above. Wastes may be submerged within the flowable, curable, monolith forming material by partially filling the interior volume with a first layer of monolith forming material, allowing the first layer of monolith forming material to partially or completely cure, thereby adhering the waste to the first layer of monolith forming material, and filling the remaining interior volume with at least one additional layer of monolith forming material, thereby preventing the buoyancy of the waste from causing it to rise through the additional layer of monolith forming material. In a similar manner, several layers of waste may be added to the interior volume, with alternating layers of monolith forming materials added to anchor each successive layer in position within the interior of the monolith.

As will be recognized by those having skill in the art, once a later of monolith forming material has cured, a second layer placed thereupon typically will not bond to the first layer. Those skilled in the art have solved this problem by inserting so called cold joint dowels in the monolith forming materials which extend through each successive layer of monolith forming materials. In this manner, when a new layer is placed on top of the previously cured layer of monolith forming material, the cold joint dowels act to bind each of the two levels together. The use of removable walls thus adds another advantage to the present invention. By attaching cold joint dowel guides to the removable walls, the placement of the cold joint dowels is facilitated. As the removable walls are moved and reused, the labor necessary to place successive sets of cold joint dowels is thereby reduced, as the cold joint dowel guides are already in place, and do not have to be reattached to the removable walls. Thus, preferably, the cold joint dowel guides are attached with a hinge, allowing them to be positioned parallel to the removable walls when not in use or when the removable walls are in transit.

Wastes may be more easily placed within the interior volume if one of the removable walls is provided as having a door, thereby allowing the ingress and egress of the waste, and the use of mechanical loading of the waste with trucks, forklifts and the like. The door is then closed to hold in the monolith forming material, when added. The removable walls may be removed using any conventional means, including but not limited to hydraulic or pneumatic jacks. Removal is assisted if the interior surfaces of the removable walls are first treated with a release agent, prior to submerging the waste within the monolith forming material. In fact, the use of such release agents may eliminate the necessity of using equipment such as hydraulic, pneumatic or mechanical jacks to remove the walls. Suitable release agents include, but are not limited to, organic lubricants and plastomer sheeting. The monolith forming material may be, introduced over the top of the removable walls or through apertures provided in the sides of the removable walls. When not in use, plugs may be placed in these apertures to prevent the escape of the monolith forming materials during pouring. Preferably, the monolith forming material is vibrated as it is introduced into the interior volume, thereby preventing segregation of the constituents of the monolith forming materials. Vibration may be provided with a vibrator manifold assembly attached to the removable walls, and/or with a vibrator on the end of the pump hose used to introduce the monolith forming materials. Curing of the monolith forming material may be assisted by placing a plastomer cover over the monolith forming material, heating the monolith forming material, and/or by spraying aqueous curing fluid, or water, on the monolith forming material. Curing in cold weather may be assisted with heaters, which may be attached directly to the removable walls. The removable walls are preferably built of steel, and preferably reinforced with I-beams to provide structural rigidity. The removable walls may be free standing, or supported with braces. The braces are preferably attached to the removable walls with hinges, thereby allowing them to be folded parallel to the removable walls when being moved. Additionally, the walls may be provided with monitoring equipment attached, thereby allowing measurements including, but not limited to radioactivity or the diffusion of hazardous substances, from wastes contained within the monolith. Suitable monitoring equipment includes, but is not limited to, radiation detectors such as those available from Eberline Instruments of Sante Fe, N. Mex., and gas detection instruments, such as those available from Dynamation of Ann Arbor Mich.

Once formed, the monolith containing hazardous and/or radioactive wastes is expanded by attaching removable walls to at least one side of the monolith, thereby forming an interior volume defined by the removable walls and at least one side of the monolith, placing waste within the interior volume, submerging the waste within a flowable, curable, monolith forming material by filling the interior volume with a monolith forming material, and allowing the monolith forming material to cure to a solidified state, thereby forming an expanded monolith integral with the existing monolith. The walls are then removed, thereby leaving the waste encased within said expanded monolith and allowing the removable walls to be reused for further expansion of the monolith. When expanding an existing monlith, the removable walls are preferably attached to the monolith with removable bolts or anchors. All of the methods useful in the formation of the original monolith, including methods for submerging waste; providing a door for placing waste; methods for removing the removable walls, including treating the walls with a release agent, and hydraulic or pneumatic jacks; introducing monolith forming material over the top of the removable walls or through apertures provided in the sides of the removable walls; vibrating the monolith forming materials; and curing of the monolith forming material, are equally useful in expanding the monolith. The removable walls used in expanding the monolith are configured to allow attaching them to the existing monolith, preferably, but not meant to be limiting, with bolts or anchors. They are also preferably built of steel, and preferably reinforced with I-beams to provide structural rigidity. The removable walls used for expanding the monolith are preferably free standing, but may also be supported with braces. Braces are preferably attached to the sides of the removable walls with hinges, allowing them to be folded parallel to the removable walls when not in use, such as during transit or when the removable walls are being repositioned. Additionally, the structural rigidity of the removable walls may be enhanced with the use of stabilizing braces. Preferably, the stabilizing braces are removable, allowing them to be attached, thereby adding structural rigidity, when the removable walls are being repositioned, and removed when they might interfere with operations, such as loading the interior volume with waste or adding monolith forming materials.

As used herein, "monolith forming material" should be interpreted to include any suitable material which may be poured and will then cure to form a hardened mass capable of encasing wastes. Typically, the in practice of the present invention, monolithic forming materials will be Portland cement together with various additives, including but not limited to metal or polymer fiber, used for strengthening the monolith; metal shot for radiation shielding; natural rock and sand aggregate for cost reduction; zeolite minerals and synthetics, as well as apatite for containment capture; smectite and kaolin clays for containment capture, concrete durability and reduction of containment diffusion; fly ash for heat of hydration control, strength, and reduction of containment diffusion; blast furnace slag and silica fume for strength and reduction of containment diffusion; plasticizers for concrete pumping and handling; air entertainment agent for durability; and corrosion inhibitors for internal metal waste package longevity. As a practical matter, the specific wastes being disposed will dictate the appropriate additives for a each monolith, and the location of the monolith being formed will effect the availability and thus the price of the various constituents of the monolithic forming materials and additives which may be used as substitutes for one and another. The exact combination of monolithic forming materials will thus typically be selected as the lowest cost material which will still meet applicable laws, rules and regulations. Those having skill in the art are well versed in the particular combinations and ratios of additives appropriate for the various wastes which may be disposed of using the present invention, as well as the applicable laws, rules and regulations which will govern their disposal. No further discussion of these monolithic materials and the various additives is therefore necessary to enable those having skill in the art to practice the best mode of the present invention.

DESCRIPTION OF THE PREFERRED EMBODIMENTS

Figure 1:
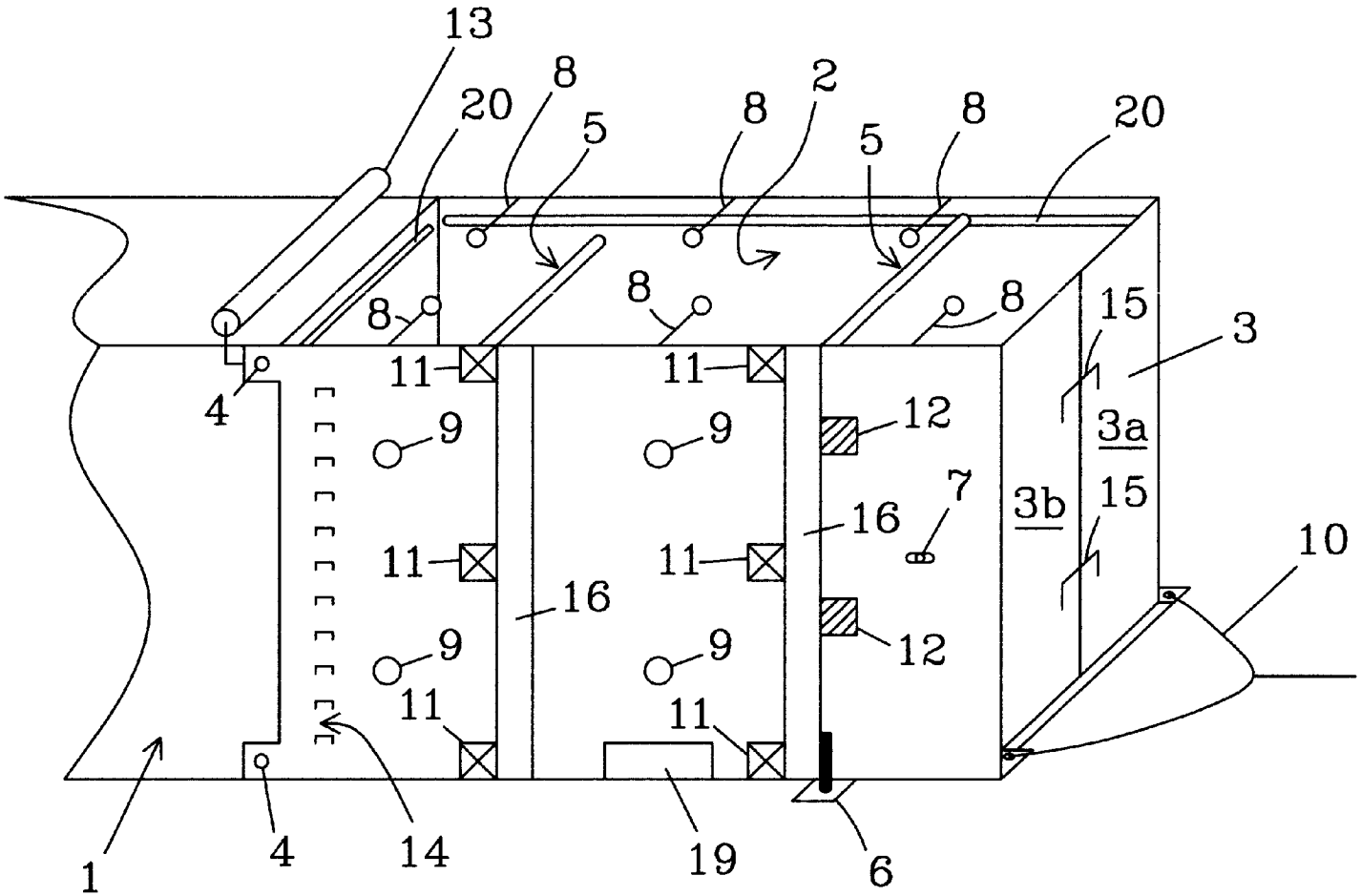
FIG. 1. is a view of an apparatus used to carry out a preferred embodiment of the present invention.
Figure 2:
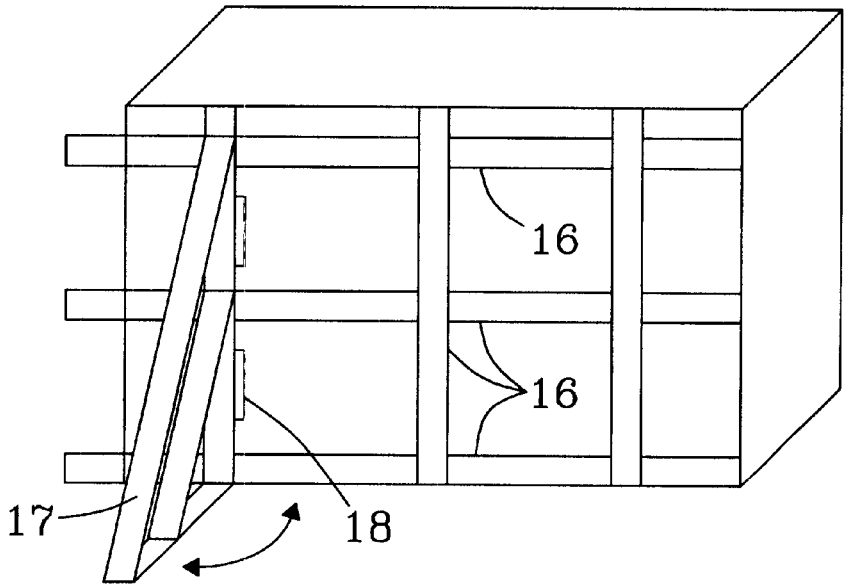
FIG. 2. is a view of folding braces used to carry out a preferred embodiment of the present invention.
Figure 5:
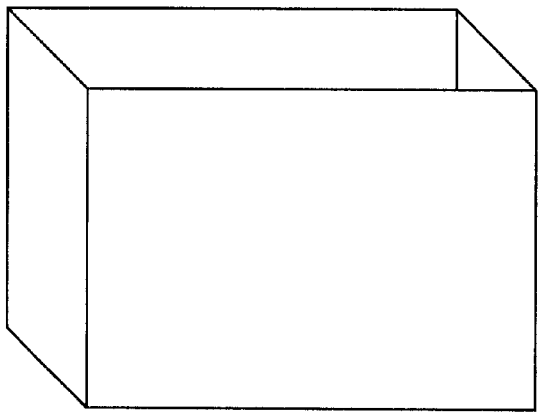
FIG. 5. is a view of an apparatus used to carry out a preferred embodiment of the present invention.

While the general nature and operation of the present invention has been shown and described, a more in depth understanding of the invention may be acquired through a discussion of some preferred embodiments of the present invention. The examples provided in these preferred embodiments are illustrative of the nature and operation of the present invention, those skilled in the art will recognize that the general principles demonstrated in the preferred embodiments are readily applicable in a wide variety of manner, all of which would fall within the contemplation of the present invention. Accordingly, the following description of the present invention should only be regarded as illustrating the practice of the present invention, and the invention should not be understood as limited to the particular examples set forth herein, but rather should be broadly construed as including other variations and combinations within the spirit and scope of the claims set forth in the concluding portion of this specification In a first preferred embodiment of the present invention, a first monolith 1 is formed within the interior of four removable walls as shown in FIG. 5 and described in the summary of the invention. The first monolith 1 is preferably rectangular in shape, although the formation of other shapes is possible with the method of the present invention. As illustrated in FIG. 1, this existing monolith 1 may be easily and repeatedly expanded. After the first monolith 1 is sufficiently cured, the back wall (not shown) of the four removable walls is detached from the side walls 2, and the four removable walls are released from the monolith 1 using any appropriate means, including but not limited to hydraulic, pneumatic or mechanical jacks. The two side walls 2 and the front wall 3 are then pulled forward as a unit by any appropriate means. For example, as shown in FIG. 1, a cable 10 is provided at the bottom front of the two side walls 2 which may then be pulled forward with a portable winch, block and tackle, crawler, tractor or any other means (not shown). The two side walls 2 and the front wall 3 are pulled forward a suitable distance depending on the number and size of the next waste containers (not shown) to be isolated. Removable stabilizing braces 5 are attached to the two side walls 2 during transit to facilitate the structural rigidity of the two side wall 2 and front wall 3 unit. Jacks 6, are preferably attached to the removable walls for convenience and to reduce the total labor necessary for the practice of the present invention, and are then used to level the two side wall 2 and front wall 3 unit. A bubble type level 7 is also preferably attached to the removable walls for convenience and to reduce the total labor necessary for the practice of the present invention, is used to indicate when the side walls 2 are level. As shown in FIG. 2, braces 17 may then be deployed to assist in holding side walls 2 upright. Preferably, braces 17 are attached to side walls 2 with hinges 18 to allow braces 17 to be folded parallel to side walls 2 when not in use or during transport. The removable walls may be fabricated of any suitable material. Due to its strength and rigidity, steel is preferred. I-beam type reinforcements, 16 are added both horizontally and vertically to add rigidity and strength to the overall structure. A ladder 14 may also be provided, to allow easy access to the top of the side wall 2. Heaters 19 may also be attached to the removable walls to assist curing in cold weather.

Returning to FIG. 1, once the two side walls 2 and the front wall 3 are in place, the two side walls 2 are attached to the existing monolith 1 by bolts or anchors 4. Cold joint dowels (not shown) are then positioned vertically in the interior volume formed by the existing monolith 1, the two side walls 2 and the front wall 3, utilizing cold joint dowel guides 8 and release agents are applied to the interior surfaces of the two side walls 2 and front wall 3.

A floor, if not already in place, is then poured either over the top of the two side wall 2 and front wall 3 unit, through apertures 9 in the sides of the two side walls 2 or through an open door. After the floor has cured, waste (not shown) may be introduced into the interior volume either by loading waste either over the top of the two side wall 2 and front wall 3 unit, or by opening doors 3*a* and 3*b* provided in front wall 3. When pouring monolith forming materials into the interior volume, a suitable closing mechanism 15, including but not limited to a clasp or latch is used to hold doors 3*a* and 3*b* closed, containing the monolith forming materials and waste therein. Wastes and monolith forming materials are then added as described in the summary of the invention, until the interior volume is full, thereby forming an expanded monolith. During the pouring of monolith forming materials, vibrator manifold assemblies 11 attached to the removable walls are used along with a vibrator on the end of the pump hose (not shown) to eliminate void volumes within the monolith forming materials. Monitoring equipment 12 is preferably attached to the side walls 2, thereby allowing measurements of radioactivity or the diffusion of hazardous substances, from wastes contained within the monolith. Preferably, a roll of plastemere sheeting 13 is attached to the corners of side walls 2, thereby allowing the sheeting to be conveniently rolled on top of each successive layer of monolith forming material to assist in curing. Aqueous curing fluid, or water, may be sprayed on the monolith forming materials through spray bars 20 which are preferably attached to the walls 2 and 3. The process is then repeated, resulting in a long rectangle of a continuous monolith 1.

Figure 3:
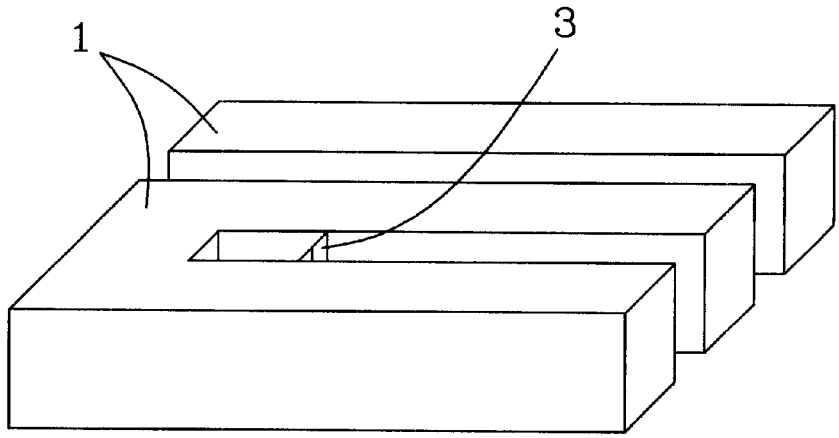
FIG. 3. is a view of a first method of carrying out the present invention.

As shown in FIG. 3 rows of the thus formed monolith 1 may then be filled in by first attaching a back wall (not shown) at one end of the rows of monolith, and a front wall 3 in between the rows of monolith, and adding waste and monolith forming materials as described above. The space in between the rows of monolith 1 are filled in by utilizing the front wall 3 in the same manner as before (except that the front wall 3, as opposed to the side walls 2, is attached to the existing monoliths). The side walls 2 are no longer necessary as the sides of the two parallel monoliths 1, together with the front wall 3, now serve to form interior volume for receiving waste and monolith forming materials.

Figure 4:
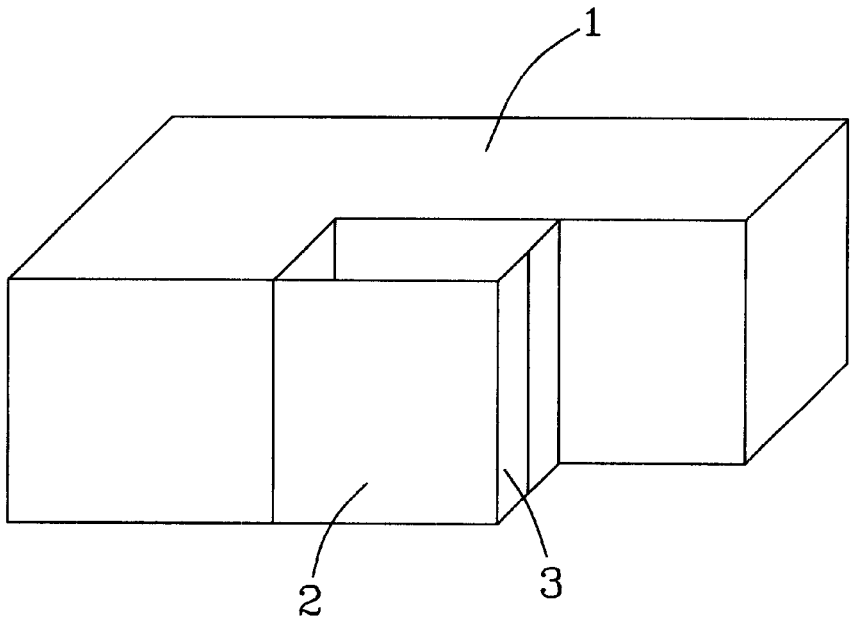
FIG. 4. is a view of a second method of carrying out the present invention.

In a similar manner, as shown in FIG. 4, in a long rectangle of a continuous monolith 1 may be expanded in by first attaching a back wall (not shown), a side wall 2 and a front wall 3 to the side of one end of a long rectangle of a continuous monolith 1, and adding waste and monolith forming materials as described above. The monolith 1 is then further expanded by utilizing a side wall 2 and the front wall 3 in the same manner as before.

The invention should in no way be limited to the specific examples set forth in these descriptions of the preferred embodiments; they are presented merely to illustrate preferred and acceptable methods of practicing the present invention. Further, while a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method for forming a monolith containing hazardous and/or radioactive wastes comprising the steps of:

a) forming an interior volume by placing removable walls on a waste disposal site, b) forming a floor within said interior volume by pouring in a flowable, curable, monolith forming material, c) placing waste within the interior volume on top of said floor, d) submerging the waste within additional monolith forming material, by placing the additional monolith forming material within the interior volume, and e) allowing the monolith forming material to cure to a solidified state, thereby forming a monolith with the waste encased within said monolith.

2. The method of claim 1 wherein the step of submerging the waste within the additional monolith forming material is accomplished by the steps of:

a) partially filling the interior volume with a first layer of additional monolith forming material, b) allowing the first layer of additional monolith forming material to partially or completely cure, thereby adhering the waste to the first layer of monolith forming material, c) filling the remaining interior volume with at least one second additional layer of monolith forming material, thereby preventing the buoyancy of the waste from causing it to rise through the additional layer of monolith forming material.

3. The method of claim 1 wherein at least one of said removable walls is provided as having a door, thereby allowing the ingress and egress of the waste.

4. The method of claim 1 wherein at least two of said removable walls are connected with removable stabilizing braces, thereby facilitating the structural rigidity of the removable walls.

5. The method of claim 1 wherein at least one of said removable walls is provided as having a cold joint dowel guide, thereby facilitating the placement of cold joint dowels which extend through at least two layers of monolith forming materials.

6. The method of claim 1 further comprising the step of removing the removable walls after curing the monolith.

7. The method of claim 1 wherein the interior surfaces of the removable walls are treated with a release agent prior to submerging the waste within a flowable, curable, monolith forming material.

8. The method of claim 7 wherein the release agent is selected from the group consisting of an organic lubricant and plastomer sheeting.

9. The method of claim 1 wherein the flowable, curable, monolith forming material is introduced over the top of the removable walls.

10. The method of claim 1 wherein the flowable, curable, monolith forming material is introduced through apertures in the sides of the removable walls.

11. The method of claim 1 wherein the flowable, curable, monolith forming material is vibrated as it is introduced into the interior volume.

12. The method of claim 1 wherein allowing the monolith forming material to cure to a solidified state is assisted by placing a plastomer cover over the monolith forming material.

13. The method of claim 1 wherein allowing the monolith forming material to cure to a solidified state is assisted by the heating the monolith forming material.

14. The method of claim 1 wherein allowing the monolith forming material to cure to a solidified state is assisted by spraying aqueous curing fluid, or water on the monolith forming material.

15. The method of claim 1 wherein the removable walls are supported with braces.

16. The method of claim 15 wherein the braces are attached to the removable walls with hinges, thereby allowing them to be folded parallel to the removable walls when the removable walls are being moved.

17. The method of claim 1 wherein monitoring equipment is attached to said walls.

18. The method of claim 1 wherein spray bars are attached to said walls.

19. A method for expanding a monolith containing hazardous and/or radioactive wastes comprising the steps of:

a) attaching removable walls to at least one side of the monolith, thereby forming an interior volume defined by the removable walls and at least one side of the monolith, b) forming a floor therein by pouring a layer of monolith forming materials within the interior volume, c) placing waste within the interior volume on top of the floor, d) submerging the waste within monolith forming material by filling the interior volume with an additional layer of monolith forming material, e) allowing the monolith forming material to cure to a solidified state, thereby forming an expanded monolith having the waste encased within said expanded monolith.

20. The method of claim 19 wherein the step of submerging waste within the monolith forming material is accomplished by the steps of:

a) partially filling the interior volume with a first layer of monolith forming material, b) allowing the first layer of monolith forming material to partially or completely cure, thereby adhering the waste to the first layer of monolith forming material, c) filling the remaining interior volume with at least one additional layer of monolith forming material, thereby preventing the buoyancy of the waste from causing it to rise through the additional layer of monolith forming material.

21. The method of claim 19 wherein at least one of said removable walls is provided as having a door, thereby allowing the ingress and egress of the waste.

22. The method of claim 19 wherein at least two of said removable walls are connected with removable stabilizing braces, thereby facilitating the structural rigidity of the removable walls.

23. The method of claim 19 wherein at least one of said removable walls is provided as having a cold joint dowel guide, thereby facilitating the placement of cold joint dowels which extend through at least two layers of monolith forming materials.

24. The method of claim 19 further comprising the step of removing the removable walls after curing the expanded monolith.

25. The method of claim 19 wherein the interior surfaces of the removable walls are treated with a release agent prior to submerging the waste within a flowable, curable, monolith forming material.

26. The method of claim 25 wherein the release agent is selected from the group consisting of an organic lubricant and plastomer sheeting.

27. The method of claim 19 wherein the flowable, curable, monolith forming material is introduced over the top of the removable walls.

28. The method of claim 19 wherein the flowable, curable, monolith forming material is introduced through apertures in the sides of the removable walls.

29. The method of claim 19 wherein the flowable, curable, monolith forming material is vibrated as it is introduced into the interior volume.

30. The method of claim 19 wherein allowing the monolith forming material to cure to a solidified state is assisted by placing a plastomer cover over the monolith forming material.

31. The method of claim 19 wherein allowing the monolith forming material to cure to a solidified state is assisted by the heating the monolith forming material.

32. The method of claim 19 wherein allowing the monolith forming material to cure to a solidified state is assisted by spraying aqueous curing fluid, or water on the monolith forming material.

33. The method of claim 19 wherein the removable walls are attached to the monolith with removable bolts or anchors.

34. The method of claim 19 wherein monitoring equipment is attached to said walls.

35. The method of claim 19 wherein spray bars are attached to said walls.

36. A method for forming a monolith containing hazardous and/or radioactive wastes comprising the steps of:

a) forming a floor, b) forming an interior volume by placing removable walls on the floor, c) placing waste within the interior volume, d) submerging the waste within a flowable, curable, monolith forming material, by placing the monolith forming material within the interior volume, and e) allowing the monolith forming material to cure to a solidified state, thereby forming a monolith with the waste encased within said monolith.

37. The method of claim 36 wherein the step of submerging the waste within the additional monolith forming material is accomplished by the steps of:

d) partially filling the interior volume with a first layer of monolith forming material, e) allowing the first layer of monolith forming material to partially or completely cure, thereby adhering the waste to the first layer of monolith forming material, f) filling the remaining interior volume with at least one additional layer of monolith forming material, thereby preventing the buoyancy of the waste from causing it to rise through the additional layer of monolith forming material.

38. The method of claim 36 wherein at least one of said removable walls is provided as having a door, thereby allowing the ingress and egress of the waste.

39. The method of claim 36 wherein at least two of said removable walls are connected with stabilizing braces, thereby facilitating the structural rigidity of the removable walls.

40. The method of claim 36 wherein at least one of said removable walls is provided as having a cold joint dowel guide, thereby facilitating the placement of cold joint dowels which extend through at least two layers of monolith forming materials.

41. The method of claim 36 further comprising the step of removing the removable walls after curing the monolith.

42. The method of claim 36 wherein the interior surfaces of the removable walls are treated with a release agent prior to submerging the waste within a flowable, curable, monolith forming material.

43. The method of claim 42 wherein the release agent is selected from the group consisting of an organic lubricant and plastomer sheeting.

44. The method of claim 36 wherein the flowable, curable, monolith forming material is introduced over the top of the removable walls.

45. The method of claim 36 wherein the flowable, curable, monolith forming material is introduced through apertures in the sides of the removable walls.

46. The method of claim 36 wherein the flowable, curable, monolith forming material is vibrated as it is introduced into the interior volume.

47. The method of claim 36 wherein allowing the monolith forming material to cure to a solidified state is assisted by placing a plastomer cover over the monolith forming material.

48. The method of claim 36 wherein allowing the monolith forming material to cure to a solidified state is assisted by the heating the monolith forming material.

49. The method of claim 36 wherein allowing the monolith forming material to cure to a solidified state is assisted by spraying aqueous curing fluid, or water on the monolith forming material.

50. The method of claim 36 wherein the removable walls are supported with braces.

51. The method of claim 50 wherein the braces are attached to the removable walls with hinges, thereby allowing them to be folded parallel to the removable walls when the removable walls are being moved.

52. The method of claim 36 wherein monitoring equipment is attached to said walls.

53. The method of claim 36 wherein spray bars are attached to said walls.

54. A method for expanding a monolith containing hazardous and/or radioactive wastes comprising the steps of:

a) forming a floor, b) attaching removable walls to at least one side of the monolith, thereby forming an interior volume defined by the removable walls, the floor, and at least one side of the monolith, c) placing waste within the interior volume on top of the floor, d) submerging the waste within monolith forming material by filling the interior volume with an additional layer of monolith forming material, e) allowing the monolith forming material to cure to a solidified state, thereby forming an expanded monolith having the waste encased within said expanded monolith.

55. The method of claim 54 wherein the step of submerging waste within the monolith forming material is accomplished by the steps of:

a) partially filling the interior volume with a first layer of monolith forming material, b) allowing the first layer of monolith forming material to partially or completely cure, thereby adhering the waste to the first layer of monolith forming material, c) filling the remaining interior volume with at least one additional layer of monolith forming material, thereby preventing the buoyancy of the waste from causing it to rise through the additional layer of monolith forming material.

56. The method of claim 54 wherein at least one of said removable walls is provided as having a door, thereby allowing the ingress and egress of the waste.

57. The method of claim 54 wherein at least two of said removable walls are connected with stabilizing braces, thereby facilitating the structural rigidity of the removable walls.

58. The method of claim 54 wherein at least one of said removable walls is provided as having a cold joint dowel guide, thereby facilitating the placement of cold joint dowels which extend through at least two layers of monolith forming materials.

59. The method of claim 54 further comprising the step of removing the removable walls after curing the expanded monolith.

60. The method of claim 54 wherein the interior surfaces of the removable walls are treated with a release agent prior to submerging the waste within a flowable, curable, monolith forming material.

61. The method of claim 60 wherein the release agent is selected from the group consisting of an organic lubricant and plastomer sheeting.

62. The method of claim 54 wherein the flowable, curable, monolith forming material is introduced over the top of the removable walls.

63. The method of claim 54 wherein the flowable, curable, monolith forming material is introduced through apertures in the sides of the removable walls.

64. The method of claim 54 wherein the flowable, curable, monolith forming material is vibrated as it is introduced into the interior volume.

65. The method of claim 54 wherein allowing the monolith forming material to cure to a solidified state is assisted by placing a plastomer cover over the monolith forming material.

66. The method of claim 54 wherein allowing the monolith forming material to cure to a solidified state is assisted by the heating the monolith forming material.

67. The method of claim 54 wherein allowing the monolith forming material to cure to a solidified state is assisted by spraying aqueous curing fluid, or water on the monolith forming material.

68. The method of claim 54 wherein the removable walls are attached to the monolith with removable bolts or anchors.

69. The method of claim 54 wherein monitoring equipment is attached to said walls.

70. The method of claim 54 wherein spray bars are attached to said walls.

* * * * *